US005893558A

United States Patent [19]

König et al.

[11] Patent Number: 5,893,558

[45] Date of Patent: Apr. 13, 1999

[54] SHEET GUIDANCE CHANNEL

[75] Inventors: Volker König, Ebersbach; Reinhard Weltz, Leonberg, both of Germany

[73] Assignee: Eastman Kodak Company, Rochester, N.Y.

[21] Appl. No.: 08/906,794

[22] Filed: Aug. 5, 1997

[51] Int. Cl.[6] ..... B65H 5/00; B65H 5/02; B65H 29/20

[52] U.S. Cl. ..... 271/264; 271/272; 271/273; 271/274; 271/314

[58] Field of Search ..... 271/264, 272, 271/273, 274, 314

[56] References Cited

U.S. PATENT DOCUMENTS

| | | | |
|---|---|---|---|
| 4,614,334 | 9/1986 | Henmi et al. | 271/264 |
| 5,176,373 | 1/1993 | Namba | 271/272 |
| 5,299,371 | 4/1994 | Haberstroh | 271/272 |

FOREIGN PATENT DOCUMENTS

| | | | |
|---|---|---|---|
| 33 13 055 A1 | 10/1984 | Germany | 271/264 |
| 59/207353 | 11/1984 | Japan | 271/264 |
| 58-207353 | 11/1984 | Japan | 271/264 |
| 0061447 | 4/1985 | Japan | 271/264 |
| 0188332 | 7/1990 | Japan | 271/272 |
| 404333449A | 11/1992 | Japan | 271/264 |
| 406016281 | 1/1994 | Japan | 271/264 |
| 406001514A | 1/1994 | Japan | 271/264 |

*Primary Examiner*—William E. Terrell
*Assistant Examiner*—Wonki Park
*Attorney, Agent, or Firm*—Lawrence P. Kessler

[57] ABSTRACT

A sheet guidance channel includes a pair of opposite surfaces (2a, 2b) in which are formed elongated raised beads (12) extending in the transport direction (A—A). The elongated raised beads (12) are arranged on the two surfaces (2a, 2b) such that they are arranged in pairs opposite to one another, restricting the height of the sheet guidance channel. Relative to the central axis (M) of the surfaces (2a, 2b), the elongated raised beads (12) are inclined by an angle α in the transport direction and the elongated raised beads (12) extend in the transport direction (A—A) only over partial areas of the surfaces (2a, 2b).

10 Claims, 4 Drawing Sheets

SHEET GUIDANCE CHANNEL

FIELD OF THE INVENTION

The invention relates to a sheet guidance channel comprising a pair of opposite surfaces in which are formed elongated raised beads extending in the transport direction and being arranged in pairs opposite to each other, thereby restricting the height of the sheet guidance channel.

BACKGROUND OF THE INVENTION

Sheet transport in conventional copiers generally takes place in sheet guidance channels closed on both sides and having a constant height. Transport rollers are arranged in pairs in the sheet guidance channel in order to convey the sheet being transported through the sheet guidance channel. In addition, ribs or guide elements are formed over the full length of the sheet guidance channels for guiding the sheet. Since these ribs or guide elements along the transport route contact continually the same part of the sheet being transported, damage or contact marks can occur on the sheet.

The patent DE-A-33 13 055 describes a feeder for photographic copiers. Here a cover is shown that is shown on its side facing a sheet stack with full-length guide ribs and additional supporting ribs. The guide ribs project further forward than the supporting ribs, thereby minimizing the contact of the ejected sheet with the guide system.

Document JP-A-4-277763 discloses a device for avoiding in an image faults or irregularities that are caused by the guidance of a sheet. The guide surface has two inclined surfaces designed such that only the image-free areas of the copied paper are touched during transportation by the guide surfaces. This prevents the generation of faults or irregularities in an unfixed image.

SUMMARY OF THE INVENTION

The present invention is to provide a sheet guidance channel designed such that damage or the formation of contact marks on the sheet surface are avoided. This is achieved in accordance with the invention in that, relative to the central axis of the surfaces in the transport direction, the elongated raised beads are inclined by an angle $\alpha$, and in that the raised beads extend in the transport direction only over limited portions of such surfaces. The advantage of the device in accordance with the invention is that in the sheet guidance channel formed by two opposite surfaces raised beads are provided which are inclined by an angle relative to the central axis of the sheet guidance channel. In addition, the raised beads extend only over limited portions of the surfaces of the sheet guidance channel. By this arrangement of the raised beads, it is possible to achieve a movement of the contact point of the raised beads relative to the sheet surface.

Further advantageous embodiments of the invention can be found in the dependent claims.

BRIEF DESCRIPTION OF THE DRAWINGS

The subject matter of the invention is described on the basis of a preferred embodiment shown in the drawing. In the drawings.

DETAILED DESCRIPTION OF THE INVENTION

A sheet guidance channel is formed from two opposite surfaces. The sheet guidance channel can be designed curved or straight. The description below confines itself to a straight sheet guidance channel.

Figure 1:
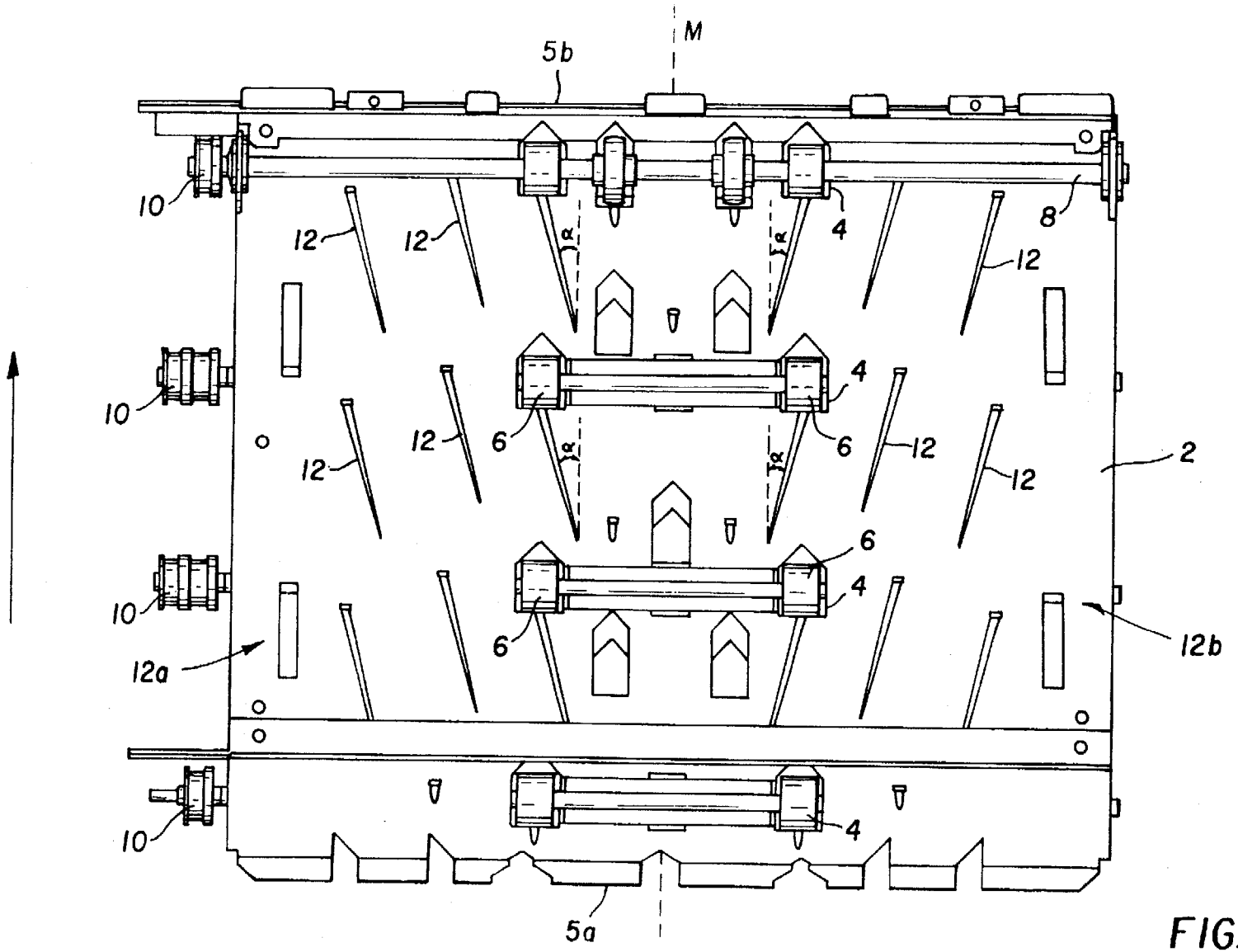
FIG. 1 is a plan view of a surface forming the sheet guidance channel.

An embodiment of a surface 2 limiting a straight sheet guidance channel either upwards and downwards is shown in FIG. 1. The transport direction of a sheet is reproduced by the arrow A—A. The sheets are conveyed through the channel in such a way that the sheets are centered on a central axis M of the sheet guidance channel that is parallel to the transport direction A—A. In addition, it is conceivable in another embodiment that the sheets are not centered relative to the central axis M, but are alignable on an edge (not shown) or corner (not shown) of the copier. The following description relates to the embodiment in which the sheets are centered relative to the central axis M.

On both sides of the central axis M, several rectangular recesses 4 tapering to a point in the transport direction A—A are provided in the surface 2. Through each of the recesses 4 protrudes a roller 6 that interacts with the other rollers 6 arranged in the recesses to move the sheet to be conveyed from an inlet 5*a* to an outlet 5*b*. The rollers 6 are arranged in pairs on a shaft 8. In the embodiment shown here, four shafts are provided, each of which is provided at one end with a drive roller 10.

Furthermore, several elongated raised beads 12 are provided on the surface 2 and are arranged obliquely to the transport direction A—A. The elongated raised beads can be divided into two groups 12*a* and 12*b*. The first group 12*a* is provided on the left of the central axis M and the second group 12*b* on the right. All raised beads 12 of the first group 12*a* are inclined by an angle $\alpha$ relative to a line parallel to the central axis M, and all raised beads 12 of the second group 12*b* are inclined by an angle $-\alpha$ relative to a line parallel to the central axis. The elongated raised beads 12 extend in the transport direction A—A only over portions of the surface 2. As further shown in FIG. 1, those elongated raised beads the least distant from the central axis M end at the recess 4. The raised beads of the first group 12*a* and the raised beads of the second group 12*b* are inclined relative to the central axis such that the contact points move laterally outwards to the lateral sheet edges when a sheet passes through in the transport direction A—A. By this it is achieved that the transported sheet is laterally stretched.

Figure 2:
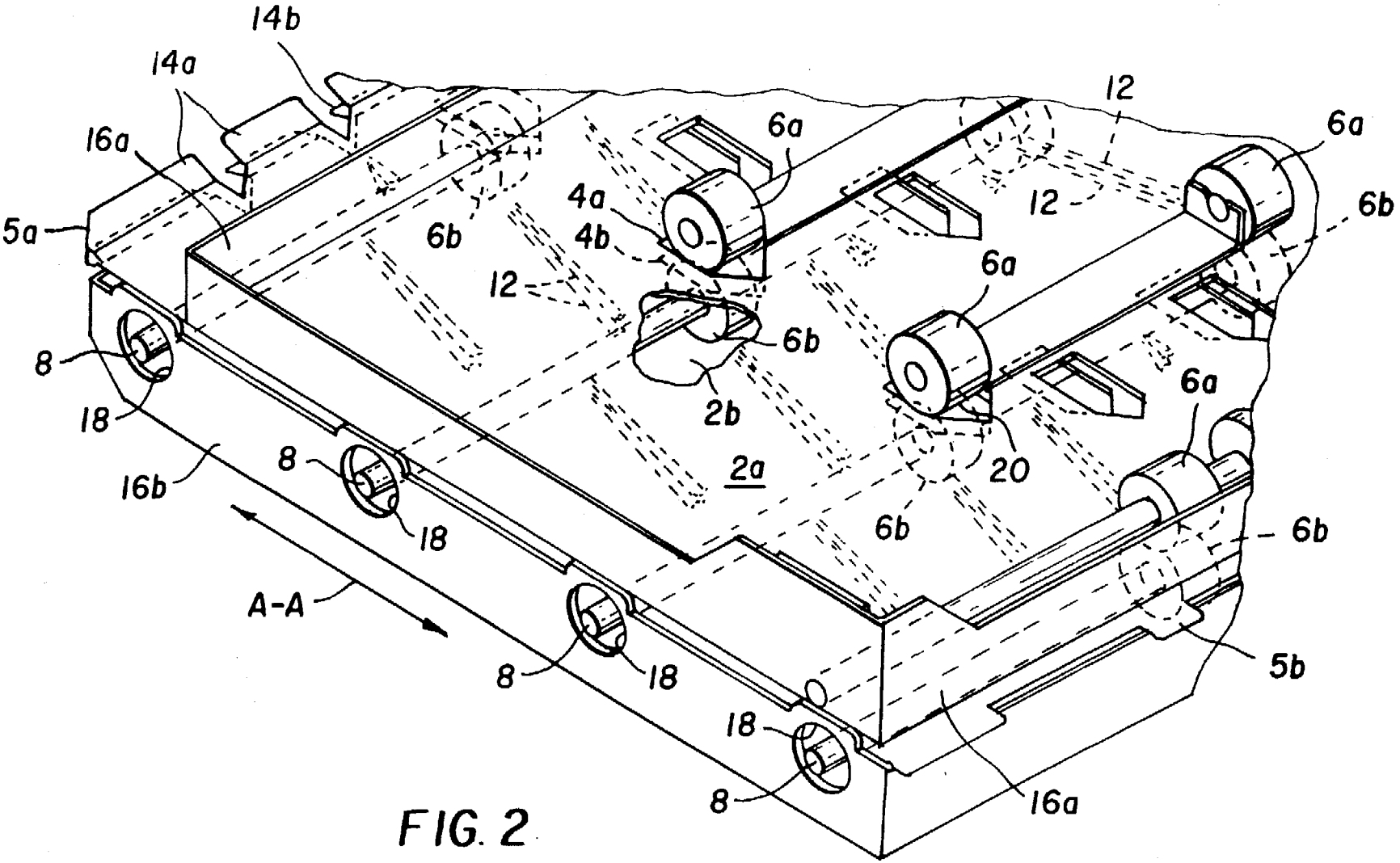
FIG. 2 is a perspective partial view of the arrangement of the two surfaces forming a sheet guidance channel.

FIG. 2 is a perspective partial view of a straight sheet guidance channel formed substantially from an upper surface 2*a* and a lower surface 2*b* arranged opposite one another. At the inlet several tabs 14*a* of the upper surface 2*a* are bent upwards at an angle. In the same way, several tabs 14*b* of the lower surface 2*b* are bent downwards at a certain angle. The funnel-like arrangement achieved in the transport direction facilitates the entry of the sheet into the sheet guidance channel. On the upper surface 2*a*, side walls 16*a* projecting vertically upwards are provided to give the upper surface additional stability. In addition, guides, spacers, retaining elements etc. (not shown) can be provided in the side walls. In the same way, downward-projecting side walls 16*b* are provided on the lower surface 2*b*. The side walls 16*b* attached parallel to the transport direction A—A are provided with several holes 18 in which are mounted the shafts 8 for driving the rollers 6 (mountings not shown). The elongated raised beads 12 are arranged on both the upper surface 2*a* and on the lower surface 2*b* such that the raised beads 12 are always opposite to one another in pairs. In this way, a local constriction of the sheet guidance channel is achieved in the areas of the raised beads. Furthermore, recesses 4*a* and 4*b* are provided in the upper surface 2*a* and the lower surface 2*b* through which the rollers 6*a* arranged above the upper surface 2*a* protrude in order to interact with the rollers 6*b* arranged underneath the lower surface 2*b*. The sheet is transported through the roller nip 20 (see FIG. 3) thus created.

Figure 3:
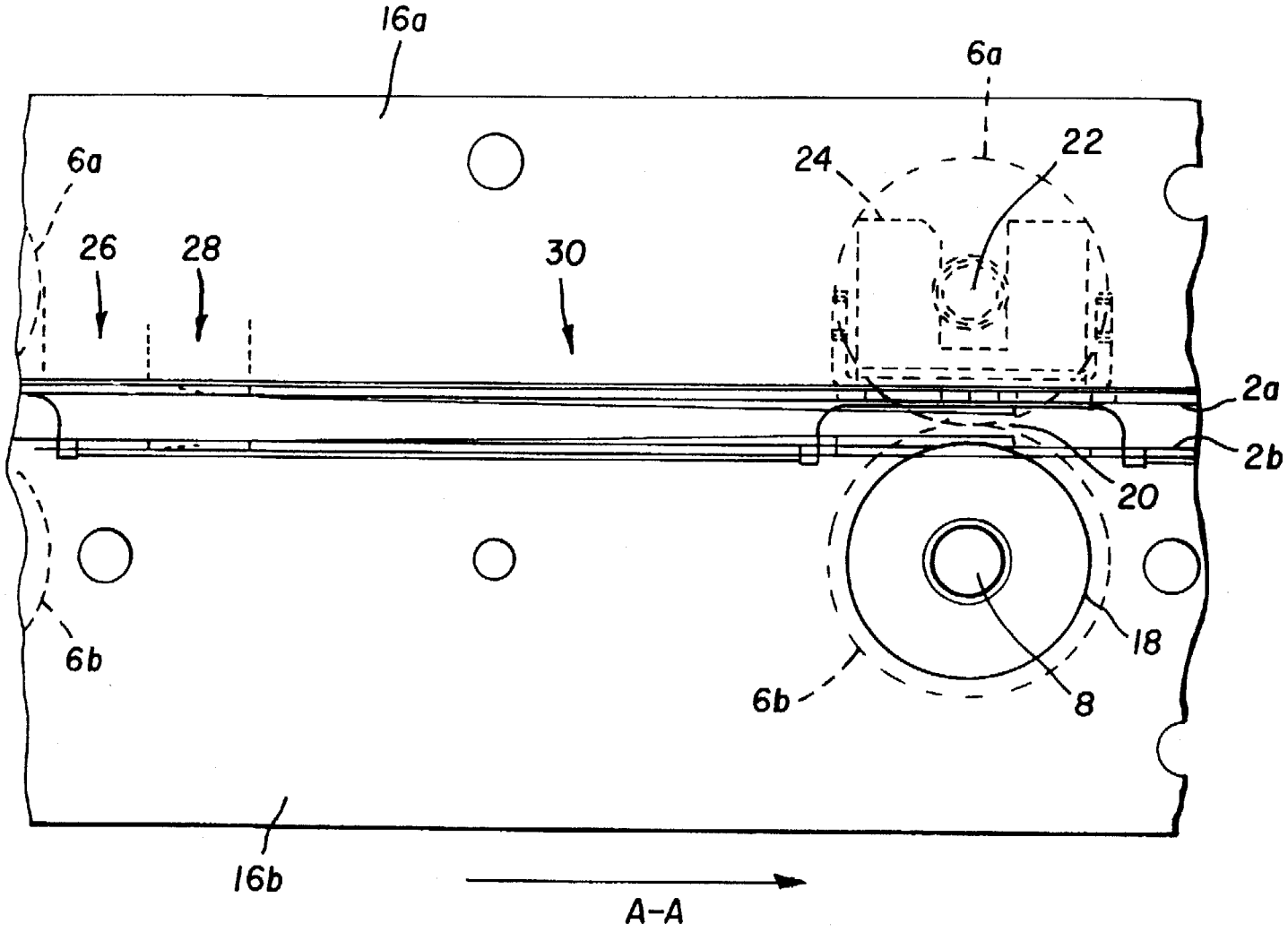
FIG. 3 is a diagrammatic side view of the sheet guidance channel with the transport rollers engaging in the sheet guidance channel.

The constriction of the sheet guidance channel caused by the raised beads in the area of the roller nip 20 is best shown in FIG. 3. Part of the side wall 16 provided vertical from the upper surface 2*a* and parallel to the transport direction A—A is shown. Part of the side wall 16*b* provided vertical from the lower surface 2*b* is also visible. The roller 6*a* above the upper surface 2*a* has a bearing 22 attached inside a holder 24. Opposite the roller 6*a* a roller 6*b* is provided that is firmly connected to the rotating shaft 8 passing through one of the holes 18 provided in the side wall 16*b*. The roller 6*a* and the roller 6*b* protrude, as already mentioned, through the recesses and touch at their respective outer circumferences, thereby creating the roller nip 20.

In the illustration in FIG. 3, parts of the rollers 6*a* and 6*b* can be seen that are provided in the transport direction A—A in front of the rollers 6*a* and 6*b* shown here. That part of the sheet guidance channel between two consecutive roller pairs can be subdivided into three areas. A first area 26 of the sheet guidance channel immediately following a roller pair 6*a*, 6*b* in the transport direction A—A has a certain width determined by the clearance of the upper surface 2*a* from the lower surface 2*b*. The first area 26 is adjacent to a second area 28 and a third area 30 whose extent is determined substantially by the raised bead 12 provided in the upper surface 6*a* or lower surface 6*b*. The area 28 is used to keep the sheet to be transported clear of the upper or lower surface respectively and thereby prevent sticking of the sheet due to adhesion in those areas in which no raised beads are provided. The second area 28 has a steeper incline than the third area 30 adjacent to the second area 28. The third area 30, which is substantially longer than the second area 28, extends with a constant incline to the rollers 6*a* and 6*b*. The sheet guidance channel therefore narrows from the outlet of one roller pair to the inlet of the next roller pair.

Figure 4A:
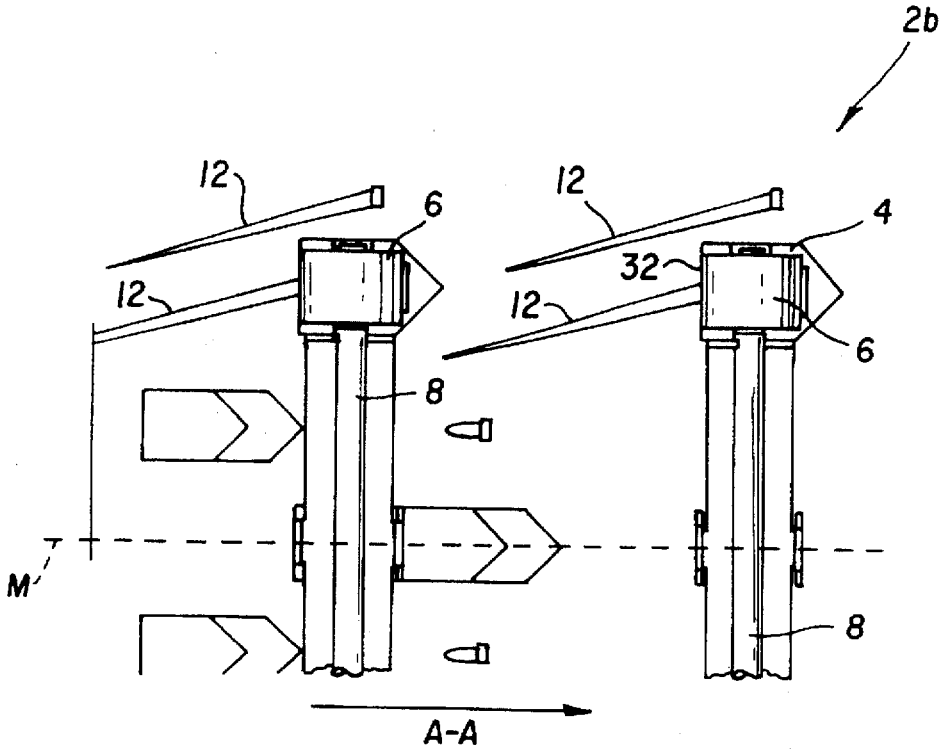
FIGS. 4*a* and 4*b* are respectively a plan view of an embodiment of the arrangement of the raised beads relative to the transport rollers, and a perspective view of the embodiment shown in FIG. 4*a*.
Figure 4B:
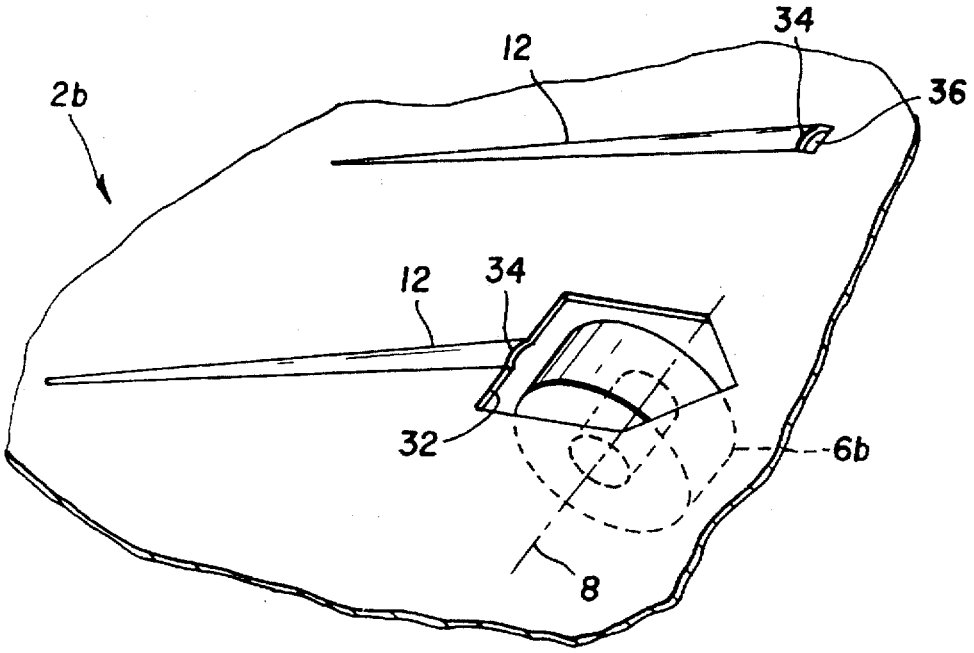

FIGS. 4*a* and 4*b* show the arrangement of the elongated raised beads 12 in relation to the rollers. The plan view (FIG. 4*a*) onto the lower surface 2*b* shows that the elongated raised beads 12 are arranged in pairs in the vicinity of the rollers 6 or recesses 4 for the rollers. The elongated raised bead the least distant from the central axis M of the sheet guidance channel ends at an edge 32 of the recess 4 vertical to the transport direction A—A. The elongated raised bead 12 provided next to it is arranged such that the raised bead 12 in the transport direction A—A later projects from the surface 2*b* and extends far enough in the transport direction for the end of the raised bead 12 in the transport direction to be in the area of the shaft 8 of the roller 6.

The perspective view (FIG. 4*b*) of the arrangement of the elongated raised beads 12 also shows the form of the raised beads 12. FIG. 4*b* also shows a plan view onto a partial area of the lower surface 2*b*. The elongated raised beads 12 have a continuous and rounded outer contour, with the dimensions of the raised beads transverse to the transport direction A—A increasing as they extend further in the transport direction A—A. In the embodiment shown here, the cross-section through the raised beads has the form of an arc. In the embodiment shown in FIG. 4*b*, the ends of the raised beads 12 have (as already mentioned above) the form of an arc 34. If the raised bead 12 ends at a recess 4 for a roller 6, the arc 34 of the raised bead merges continuously into the edge 32 of the recess 4 arranged vertically to the transport direction A—A. If the raised bead 12 does not end at a recess 4, a penetration 36 in the lower surface 2*b* can be joined to it for production reasons in the transport direction A—A. Furthermore, a further embodiment is shown in FIG. 4*b*. Here the end of the raised bead 12 furthest from the central axis M of the sheet guidance channel coincides with the outer circumference of the shaft 8 on which the lower rollers 6*b* are attached.

The present invention has been described with respect to a preferred embodiment, however modifications can also be made that are within the skills of a person skilled in the art without leaving the scope of the claims below.

PARTS LIST

2 surface
2*a* upper surface
2*b* lower surface
4 recess
5*a* inlet
5*b* outlet
6 rollers
6*a* rollers above the upper surface
6*b* rollers below the lower surface
8 shaft
10 drive roller
12 elongated raised beads
14*a* tabs of upper surface
14*b* tabs of lower surface
16*a* side walls of upper surface
16*b* side walls of lower surface
18 hole
20 roller nip
22 bearing
24 holder
26 first area of sheet guidance channel
28 second area of sheet guidance channel
30 third area of sheet guidance channel
32 edge of recess
34 arc
36 penetration
A—A transport direction
M central axis of sheet guidance channel
α angle

What is claimed is:

1. Sheet guidance channel comprising a pair of opposite surfaces (2*a*, 2*b*) in which are formed elongated raised beads (12) extending in the transport direction (A—A) and being arranged in pairs opposite to each other, thereby restricting the height of the sheet guidance channel, characterized in that said elongated raised beads (12) are inclined by an angle (α), lying in the respective planes of said pair of opposite surfaces relative to the central axis (M) of said surfaces (2*a*, 2*b*) in said transport direction (A—A) for movement of the contact point of said raised beads with respect to a guided sheet, and in that said raised beads (12) extend in said transport direction (A—A) only over limited portions of said surfaces (2*a*, 2*b*).

2. Sheet guidance channel according to claim 1, characterized in that said elongated raised beads (12) form two groups, where the raised beads (12) of a first group (12*a*) are inclined by the angle (α) to one side of the central axis (M) and the raised beads (12) of a second group (12*b*) are inclined by the angle (α) to the opposite side of the central axis (M).

3. Sheet guidance channel according to claim 1, characterized in that said opposite surfaces (2*a*, 2*b*) have a curved shape.

4. A sheet guidance channel according to claim 1, characterized in that said opposite surfaces (2*a*, 2*b*) have a substantially straight shape.

5. Sheet guidance channel according to claim 1, characterized in that said elongated raised beads (12) have a continuous, rounded outer contour.

6. Sheet guidance channel according to claims 1, characterized in that the elongated raised beads (12) have a ramp-like rounded outer contour divided up into three areas (26, 28, 30).

7. Sheet guidance channel according to claim 6, characterized in that the cross-section of said elongated raised beads (12) increases in the transport direction (A—A).

8. Sheet guidance channel according to claim 1, characterized in that in said opposite surfaces, opposite recesses (4) are provided through which protrude rollers (6*a*, 6*b*) that contact one another, thereby forming several nips (20) for the sheet to be transported.

9. Sheet guidance channel according to claim 8, characterized in that said elongated raised beads (12) of said first and second group, which are least distant from the central axis (M), are arranged such that the end of each of such said elongated raised beads (12) ends at an edge (32) of a respective one of said recesses (4).

10. Sheet guidance channel according to claims 8, characterized in that in the vicinity of a particular recess (4) for a particular associated transport roller (6) at least two elongated raised beads (12) are provided, of which one ends at the edge (32) of said particular recess (4) and the other passes alongside said particular recess (4) in the transport direction (A—A) and ends approximately in the area of the shaft of said particular associated transport roller (6).

* * * * *